US008180256B2

(12) United States Patent
Komatsu

(10) Patent No.: US 8,180,256 B2
(45) Date of Patent: May 15, 2012

(54) IMAGE FORMING APPARATUS FEATURING FIRST AND SECOND BRUSHES FOR CHARGING RESIDUAL TONER

(75) Inventor: Isao Komatsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 953 days.

(21) Appl. No.: 12/186,161

(22) Filed: Aug. 5, 2008

(65) Prior Publication Data

US 2009/0041502 A1 Feb. 12, 2009

(30) Foreign Application Priority Data

Aug. 10, 2007 (JP) ..... 2007-210553

(51) Int. Cl.
*G03G 15/02* (2006.01)

(52) U.S. Cl. ..... 399/175; 399/354; 430/119.85

(58) Field of Classification Search ..... 399/150, 399/149, 353, 354; 430/119.71, 119.72, 430/119.85
See application file for complete search history.

(56) References Cited

U.S. PATENT DOCUMENTS 5,778,285 A * 7/1998 Nagahara et al. ..... 399/150
6,594,457 B2 * 7/2003 Tsutsumi et al. ..... 399/101
7,751,752 B2 * 7/2010 Komatsu ..... 399/148
2004/0005158 A1 * 1/2004 Okubo et al. ..... 399/50
2008/0131153 A1 * 6/2008 Yoshikawa ..... 399/50
2009/0123184 A1 * 5/2009 Kobashi ..... 399/175

FOREIGN PATENT DOCUMENTS

JP 2005-234035 A 9/2005

* cited by examiner

*Primary Examiner* — David Porta
*Assistant Examiner* — Jessica L Eley
(74) *Attorney, Agent, or Firm* — Fitzpatrick, Cella, Harper & Scinto

(57) ABSTRACT

An image forming apparatus includes: a photosensitive member; a charging member configured to charge the photosensitive member at a photosensitive member charging position to form an electrostatic image on the photosensitive member; a developing device configured and positioned to develop the electrostatic image with toner to form a toner image; a transferring device configured to transfer the toner image to an image receiving member at a transfer position; a first brush, disposed at a position downstream of the transfer position and upstream of the photosensitive member charging position with respect to a rotational direction of the photosensitive member, configured to charge a residual toner on the photosensitive member at a toner charging position to collect the residual toner to the developing device and to be supplied with a charging bias having a polarity opposite to a regular charge polarity of the toner; and a second brush, disposed at a position downstream of the toner charging position and upstream of the photosensitive member charging position with respect to the rotational direction, configured to charge the residual toner on the photosensitive member and to be supplied with a charging bias having the same polarity as the regular charge polarity. The first brush has a fiber density smaller than that of the second brush.

8 Claims, 3 Drawing Sheets

IMAGE FORMING APPARATUS FEATURING FIRST AND SECOND BRUSHES FOR CHARGING RESIDUAL TONER

FIELD OF THE INVENTION AND RELATED ART

The present invention relates to an image forming apparatus such as a copying machine, a printer, a facsimile machine, or a multi-function machine having a plurality of functions of these machines.

An electrophotographic image forming apparatus as an output terminal such as the copying machine, the printer or the facsimile machine, or as a multi-function machine having the functions of the machines has been conventionally used widely.

In the electrophotographic image forming apparatus, a toner image is formed on an electrophotographic photosensitive member as an image bearing member and is transferred onto a transfer material such as a recording sheet or onto an intermediary transfer member, as a toner image receiving member. In such an image forming apparatus, it is necessary to sufficiently remove toner (transfer residual toner), which is not transferred from the photosensitive member onto the toner image receiving member and remains on the photosensitive member, as occasion arises. For that purpose, generally, a cleaning device for removing and collecting the transfer residual toner from the surface of the photosensitive member by using a cleaning member such as a cleaning blade contactable to the photosensitive member surface has been conventionally used. As the cleaning member, generally, a blade (cleaning blade or counter blade) formed of an elastic member contactable to the photosensitive member surface with a free end thereof directed toward an upstream side with respect to a movement direction of the photosensitive member surface is used.

In recent years, with speeding up of the image forming apparatus, lifetime expansion of a main assembly of the image forming apparatus is desired. Further, from the viewpoint of environment health, reduction of waste generation, i.e., reduction or lifetime expansion of consumables and an improvement of reliability are also required.

In the copying machine and the printer, a monochromatic machine has been conventionally used predominantly but a full-color original or output file has been advanced in an office or at home. Therefore, in order to reduce TCO (total cost of ownership), a full-color image forming apparatus equivalent to the monochromatic machine in terms of cost of an apparatus main assembly and running cost is desired.

Thus, as a system having such an advantage that the system is capable of removing transfer residual toner and increasing durable lifetime with respect to scraping of a photosensitive member, a "cleaner-less system" in which the above-described cleaning device is omitted has been employed.

As the cleaner-less system, such a system that the transfer residual toner remaining on the photosensitive member after the transfer step is removed and collected from the surface of the photosensitive member by "simultaneous development and cleaning" in a developing device and is used again.

The simultaneous development and cleaning is a method in which the transfer residual toner on the photosensitive member after the transfer is collected into the developing device in a subsequent or later developing step. That is, after the transfer, the surface of the photosensitive member is electrically charged by a charging means and then is exposed to light by an exposure means to form an electrostatic image (latent image) on the photosensitive member. Then, during the developing step of developing this electrostatic image, the transfer residual toner is collected into the developing means by a fog-removing bias (a fog-removing potential difference Vback between a DC voltage applied to the developing means and a surface potential of the photosensitive member). At this time, the toner collected by the developing means through the fog-removing bias is present at a portion (non-image portion) where the electrostatic image should not be developed with the toner.

According to this method, it is possible to omit a photosensitive member rubbing member such as a counter blade or the like and to remarkably prolong a lifetime with respect to scraping of the photosensitive member. Therefore, the use of the cleaner-less system is also useful for reducing cost.

In the cleaner-less system, in order to control a charge polarity of the transfer residual toner, it has been known that a two brush-like auxiliary charging member, i.e., two auxiliary charging brushes as auxiliary charging means provided downstream of a transfer means are used (Japanese Laid-Open Patent Application (JP-A) 2005-234035).

Herein, with respect to a movement direction of the surface of the photosensitive member, a auxiliary charging brush on an upstream side (closer to the transfer means) is referred to as an "upstream brush (first brush)" and an auxiliary charging brush on a downstream side is referred to as a "downstream brush (second brush)".

The upstream brush is constituted by a fibrous member having electroconductivity and is supplied with a voltage of a polarity opposite to a regular (normal) charge polarity of toner. On the other hand, the downstream brush is constituted by a fibrous member having electroconductivity and is supplied with a voltage of a polarity identical to the regular charge polarity of the toner. In an image forming apparatus described in JP-A 2005-234035, the upstream brush and the downstream brush has the same fiber density.

These two auxiliary charging brushes are required to have the following functions. Here, the charge polarity of the photosensitive member is negative.

A. Upstream Brush (i) When toner is transferred onto a toner image receiving member in a transfer step, a latent image potential of the photosensitive member appears again. In order that the latent image potential adversely affects a subsequent image forming step, a potential of the photosensitive member is uniformized by passing a current through the photosensitive member.

(ii) The potential of the photosensitive member is sufficiently increased to provide a potential difference between the downstream brush provided on the downstream side and the photosensitive member at a level causing electric discharge.

B. Downstream Brush (i) An electric discharge current is fed through the photosensitive member to change a reversed charge polarity of the transfer residual toner to the regular charge polarity.

(ii) The potential of the photosensitive member is lowered, so that potential convergence of the photosensitive member is enhanced by a charging means (pre-charging).

However, in the cleaner-less system using the above-described upstream brush and downstream brush having the same fiber density, due to a "clogging with toner" phenomenon of the brush, an amount of a current passing through the brush (hereinafter referred to as a "brush current amount") is decreased in some cases.

That is, during an occurrence of paper jamming (clogging with a transfer material in a conveyance path) or formation of an image having a high print ratio, a large amount of transfer residual toner is generated on the photosensitive member. In this case, there can arise such a phenomenon that the auxiliary charging brushes are clogged with the transfer residual toner to decrease an amount of a current passing from the auxiliary charging brushes through the photosensitive member.

The brush current amount can be returned to an original value by applying a bias of an opposite polarity to an ordinary polarity to the auxiliary charging brush (e.g., a bias of an identical polarity to the regular charge polarity of the toner to the upstream brush) to perform an operation for removing the toner from the auxiliary charging brush clogged with the toner. However, in same cases, the brush current amount cannot be restored with an increasing operating time of the image forming apparatus. Accordingly, the clogging with toner phenomenon itself of the auxiliary charging brush is required to be suppressed.

For example, in the case where the brush current amount of the upstream brush is decreased, the latent image potential remains on the photosensitive member, so that such a ghost phenomenon that an image prior to a current image is superposed on the current image can occur. Further, in the case where the brush current amount of the upstream brush is decreased, electrical discharge is not generated by the downstream brush and the transfer residual toner is collected by the downstream brush, so that the brush current amount of the downstream brush is also decreased. On the other hand, in the case where the brush current amount of the downstream brush is decreased, control of the charge polarity of the transfer residual toner cannot be performed properly, so that toner having a reversed charge polarity can remain on the photosensitive member in a large amount. This toner is not collected by the developing means to deposit on a subsequent toner image in some cases, i.e., image failure such as fog due to such a phenomenon can occur. Further, in the case where the brush current amount of the downstream brush is decreased, the charging of the photosensitive member by the charging means is not uniform, so that image failure such as sandpaper-like fog can occur.

SUMMARY OF THE INVENTION

A principal object of the present invention is to provide an image forming apparatus capable of suppressing an occurrence of image failure (image defect) by inclusion of toner in an upstream brush (first brush) and a downstream brush (second brush).

According to an aspect of the present invention, there is provided an image forming apparatus comprising:

a photosensitive member;

a charging member configured to electrically charge the photosensitive member at a photosensitive member charging position to form an electrostatic image on the photosensitive member;

a developing device configured and positioned to develop the electrostatic image on the photosensitive member with toner to form a toner image;

a transferring device configured to transfer the toner image on the photosensitive member to an image receiving member at a transfer position;

a first brush, disposed at a position which is downstream of the transfer position and is upstream of the photosensitive member charging position with respect to a rotational direction of the photosensitive member, configured to electrically charge a residual toner on the photosensitive member at a toner charging position to collect the residual toner to the developing device, the first brush being supplied with a charging bias having a polarity opposite to a regular charge polarity of the toner; and a second brush, disposed at a position which is downstream of the toner charging position and is upstream of the photosensitive member charging position with respect to the rotational direction, configured to electrically charge the residual toner on the photosensitive member, the second brush being supplied with a charging bias having a polarity which is same as the regular charge polarity;

wherein the first brush has a fiber density smaller than that of the second brush.

According to another aspect of the present invention, there is provided an image forming apparatus comprising:

a photosensitive member;

a charging member configured to electrically charge the photosensitive member at a photosensitive member charging position to form an electrostatic image on the photosensitive member;

a developing device configured and positioned to develop the electrostatic image on the photosensitive member with toner to form a toner image;

a transferring device configured to transfer the toner image on the photosensitive member to an image receiving member at a transfer position;

a first brush, disposed at a position which is downstream of the transfer position and is upstream of the photosensitive member charging position with respect to a rotational direction of the photosensitive member, configured to electrically charge a residual toner on the photosensitive member at a toner charging position to collect the residual toner to the developing device, the first brush being supplied with a charging bias having a polarity opposite to a regular charge polarity of the toner; and a second brush, disposed at a position which is downstream of the toner charging position and is upstream of the photosensitive member charging position with respect to the rotational direction, configured to electrically charge the residual toner on the photosensitive member, the second brush being supplied with a charging bias having a polarity which is same as the regular charge polarity;

wherein the first brush has a fiber density of 80 kF/inch$^2$ or more and 250 kF/inch$^2$ or less and the second brush has a fiber density of 300 kF/inch$^2$ or more and 600 kF/inch$^2$ or less.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The image forming apparatus according to the present invention will be described more specifically with reference to the drawings.

Embodiment 1

Figure 1:
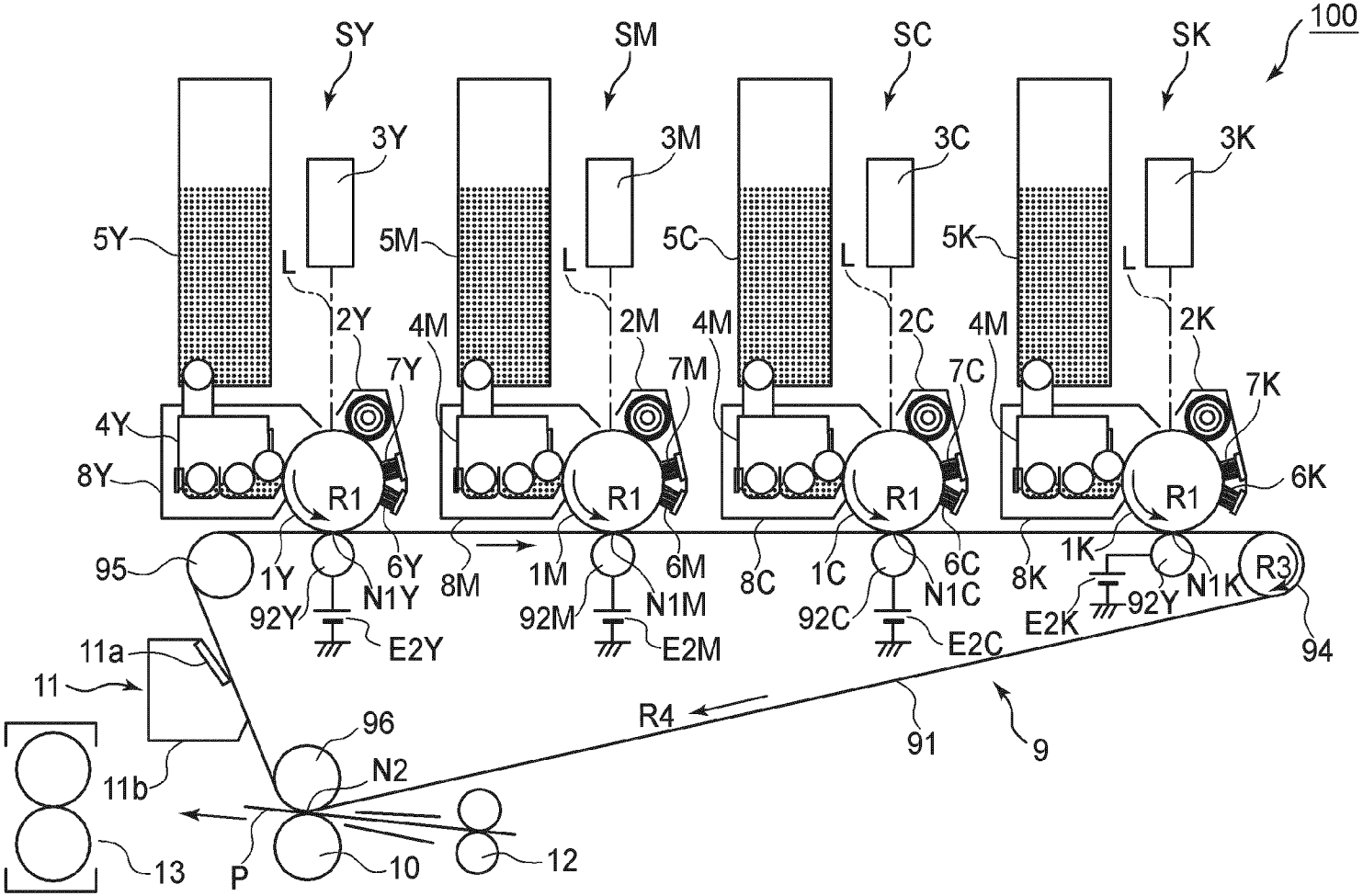
FIG. 1 is a schematic sectional view for illustrating a structure of an image forming apparatus of an embodiment of the present invention.

FIG. 1 illustrates a schematic structure of an image forming apparatus in this embodiment. An image forming apparatus 100 of this embodiment is an electrophotographic color laser (beam) printer with A3 size as a maximum sheet-passing size. The image forming apparatus 100 particularly employs a contact charging method, a reverse developing method, a tandem (in-line or four-drum) arrangement, an intermediary transfer method, and a cleaner-less system.

The image forming apparatus 100 is capable of forming and outputting a full-color image on a transfer material such as a recording sheet, an OHP sheet or a cloth, depending on image information sent from an external host apparatus connected communicatably to a main assembly of the image forming apparatus.

The image forming apparatus 100 includes first, second, third and fourth image forming stations SY, SM, SC and SK for forming color images of yellow (Y), magenta (M), cyan (C) and black (K), respectively, as a plurality of image forming portions.

In this embodiment, basic constitution and operation of each of the image forming stations SY, SM, SC and SK are substantially identical to each other except for the color of toner used. Therefore, in the case where they are particularly required to be discriminated, they are collectively described by omitting suffixes, Y, M, C and K added for representing constituents or means with respect to the colors of yellow, magenta, cyan and black, respectively.

The image forming station S includes a drum-type electrophotographic photosensitive member as an image bearing member, i.e., a photosensitive drum 1. Around the photosensitive drum 1, a charging roller 2 as a charging means, an exposure device 3 as an exposure means (electrostatic image forming means), a developing device 4 as a developing means, and so on are disposed. Further, an intermediary transfer unit 9 is disposed to oppose all the photosensitive drums 1Y, 1M, 1C and 1D of the four image forming stations SY, SM, SC and SK.

The intermediary transfer unit 9 includes an intermediary transfer belt 91 formed of an endless brush-like member as an intermediary transfer member. Further, at each of positions of the intermediary transfer belt 91 opposing the photosensitive drums of the respective image forming stations, a primary transfer 92 which is a rotatable transfer member as a primary transfer means is disposed so as to contact an inner (back) surface of the intermediary transfer belt 91. The primary transfer roller 91 presses the intermediary transfer belt 91 against the photosensitive drum 1. As a result, a nip (primary transfer nip) is formed at a primary transfer portion N1 where the intermediary transfer belt 91 and the photosensitive drum 1 contact each other. Further, at a position of the intermediary transfer belt 91 opposing a secondary transfer opposite roller 96 as one of supporting rollers for supporting the intermediary transfer belt 91, a secondary transfer roller 10 which is a rotatable transfer member as a secondary transfer means is disposed so as to contact an outer peripheral (front) surface of the intermediary transfer belt 91. As a result, a nip (secondary transfer nip) is formed at a secondary transfer portion N2 where the secondary transfer roller 10 and the intermediary transfer belt 91 contact each other.

Further, around the photosensitive drum 1, first and second auxiliary charging brushes 6 and 7 which are brush-like auxiliary charging members as first and second auxiliary charging means are disposed. These first and second auxiliary charging brushes 6 and 7 are disposed in contact with the photosensitive drum 1.

In this embodiment, in each image forming station S, the photosensitive drum 1, the charging roller 2, the developing device 4 and the first and second auxiliary charging brushes 6 and 7 are integrally supported to constitute a process cartridge detachably mountable to the apparatus main assembly. The image forming apparatus 100 is capable of forming a full-color print image by once multiple-transferring toner images successively onto the intermediary transfer belt 91 by the plurality of process cartridges and then transferring the toner images simultaneously onto a transfer material P. Four process cartridges 8Y for yellow, 8M for magenta, 8C for cyan and 8K for black are disposed in series with respect to a movement direction of the intermediary transfer belt 91.

Next, an entire operation of the image forming apparatus 100 will be described by taking the case of forming a four-color based full-color image as an example.

First, an image signal color-separated in accordance with a signal from the external host apparatus connected communicatably to the image forming apparatus 100 is generated. Then, depending on this signal, toner images of the respective colors are formed on the photosensitive drums 1Y, 1M, 1C and 1K in the process cartridges 8Y, 8M, 8C and 8K of the image forming stations SY, SM, SC and SK, respectively.

In each process cartridge 8, the surface of the photosensitive drum 1 is electrically charged uniformly by the charging roller 2. Then, the uniformly charged surface of the photosensitive drum 1 is subjected to scanning exposure, so that an electrostatic image (latent image) of a color component corresponding to an objective color image in each of the image forming stations S is formed on the photosensitive drum 1. Then, to this electrostatic image, toner of a developer is supplied by the developing device 4, so that the electrostatic image is developed as a toner image.

The toner images formed on the respective photosensitive drum 1 are (primary-)transferred successively onto the intermediary transfer belt 91 at the respective primary transfer portions N1 in a superposition manner. At this time, to the primary transfer roller 92, a primary transfer bias voltage having a polarity opposite to a regular charge polarity of the toner is applied.

Then, the multiple toner images formed on the intermediary transfer belt 91 are simultaneously (secondary-)transferred onto a transfer material P fed to the secondary transfer portion N2. At this time, to the secondary transfer roller 10, a secondary transfer bias voltage having the polarity opposite to the regular charge polarity of the toner is applied. The transfer material P is supplied from a transfer material feeding means (not shown) to the secondary transfer portion N2 through a pair of sheet-feeding rollers 12 as a feeding means with predetermined timing.

Then, the transfer material P is conveyed to a fixing device 13 as a fixing means, in which the toner image is melted and fixed on the transfer material P under application of heat and pressure. Thereafter, the transfer material P is discharged out of the image forming apparatus to provide a full-color print image.

Toner (transfer residual toner) remaining on the photosensitive drum 1 after the primary transfer is, as specifically described later, collected by the developing device 4 through the simultaneous development and cleaning after the toner passes through contact portions between the photosensitive drum 1 and the first and second auxiliary charging brushes 6 and 7.

Further, toner remaining on the intermediary transfer belt 91 after the secondary transfer is removed and collected by an intermediary transfer member cleaner 11 as an intermediary transfer member cleaning means. The intermediary transfer member cleaner 11 includes an elastic blade (cleaning blade) 11*a*, contactable to the intermediary transfer belt 91, as a cleaning member and a collected toner container 11*b*. Then, the toner on the intermediary transfer belt 91 is scraped by the cleaning blade 11*a* to be accommodated into the collected toner container 11*b*.

Figure 2:
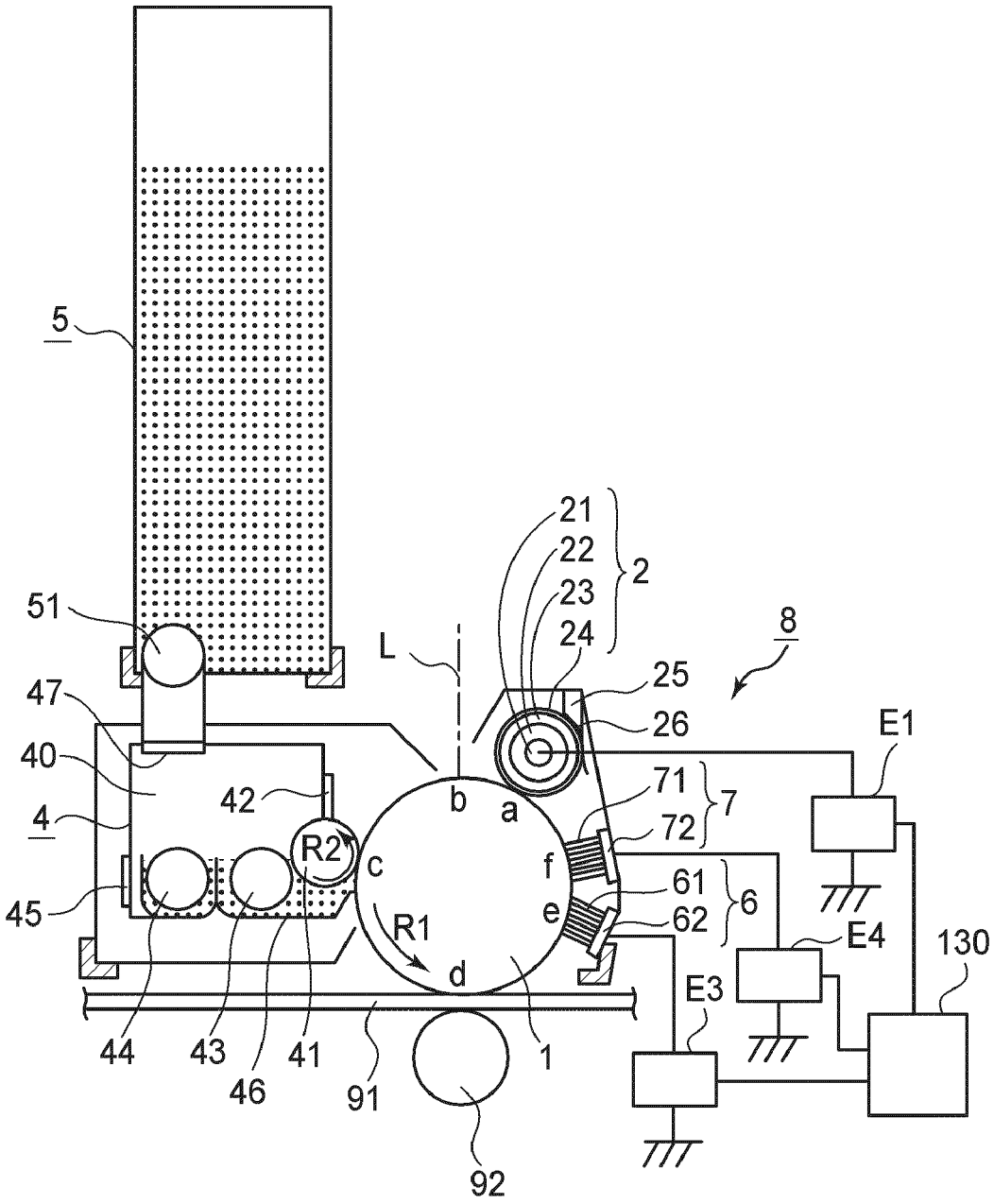
FIG. 2 is a schematic sectional view for specifically illustrating an image forming portion of the image forming apparatus.

Next, referring to FIG. 2, respective constituents or means of the image forming apparatus 100 of this embodiment will be described more specifically.

The image forming apparatus 100 includes a rotatable drum-type electrophotographic photosensitive member as a movable image bearing member, i.e., the photosensitive drum 1. In this embodiment, the photosensitive drum 1 includes an electroconductive supporting member (base material) and a photosensitive layer of an organic photoconductor (OPC) disposed on the supporting member. The photosensitive drum 1 has an outer diameter of 30 mm and is rotationally driven in a direction of an indicated arrow R1 (counterclockwise direction) at a surface moving speed (peripheral speed) of 204 mm/sec.

The image forming apparatus 100 includes the charging roller 2 which is a contact charging device as the charging means. In this embodiment, the photosensitive member 1 is uniformly charged to a predetermined polarity (negative in this embodiment) and a predetermined potential by applying a voltage to the charging roller 2 under a predetermined condition. In this embodiment, the charging roller 2 has a length of 320 mm with respect to a longitudinal direction (rotational axis direction) thereof. Further, in this embodiment, the charging roller 2 has a three-layer structure prepared by laminating, on an outer peripheral surface of a core metal (supporting member) 21, a lower layer 22, a middle layer 23 and a surface layer 24 in this order. The lower layer 22 is a foamed sponge layer for decreasing charging noise. The middle layer 23 is a resistance layer for obtaining a uniform electric resistance of the charging roller 2 as a whole. The surface layer 24 is a protection layer provided so as to prevent an occurrence of leakage even in the case where a defect such a pin-hole is present on the photosensitive drum 1. In this embodiment, a stainless steel rod having a diameter of 6 mm is used as the core metal 21 and the surface layer 24 is formed of a fluorine-containing resin material in which carbon black is dispersed. The charging roller 2 has an outer diameter of 14 mm as a roller and has an electric resistance of $10^4\Omega$ to $10^7\Omega$ as the roller. The charging roller 2 is rotatably supported by bearing members at both ends of the core metal 21 and is urged against the photosensitive drum 1 by urging springs as an urging means. As a result, the charging roller 2 press-contacts the photosensitive drum 1 surface with a predetermined urging (pressing) force. Further, the charging roller 2 is rotated by rotation of the photosensitive drum 1.

To the charging roller 2, an oscillating voltage in the form of a predetermined DC voltage biased with an AC voltage with a predetermined frequency as a charging bias voltage (Vdc+Vac) is applied from a charging bias voltage source E1 as a charging voltage applying means. This charging bias voltage is applied to the charging roller 2 through the core metal 21. As a result, the peripheral surface of the rotating photosensitive member is electrically charged to the predetermined potential. In this embodiment, the charging bias voltage is an oscillating voltage in the form of a DC voltage of −500 V biased with an AC voltage of sine wave having a frequency of 1270 Hz and a peak-to-peak voltage Vpp of 1400 V. Such a charging bias voltage is applied to the charging roller 2, so that the peripheral surface of the photosensitive drum 1 is uniformly charged to −500 V (dark portion potential Vd). A contact portion between the charging roller 2 and the photosensitive drum 1 on the peripheral surface of the photosensitive drum 1 is a charging portion a.

In this embodiment, in order to clean the charging roller 2, a cleaning film formed of a flexible film as a charging roller cleaning member 26 is provided. The cleaning film 26 is disposed in parallel to the charging roller 2 with respect to the longitudinal direction of the charging roller 2. Further, the cleaning film 26 is fixed, at one end, to a supporting member 25 reciprocating in the longitudinal direction with a certain amount of movement and forms a contact nip with the charging roller 2 on a surface of a free end thereof. The supporting member 25 is driven by a driving motor of the image forming apparatus 100 through a gear train to reciprocate in the longitudinal direction with the certain amount of movement, so that the surface layer 24 of the charging roller 2 is rubbed with the cleaning film 26. As a result, a deposited contamination (fine powdery toner, external additive, etc.) on the surface layer 24 of the charging roller 2 is removed.

In this embodiment, as the exposure means, a laser beam scanner (exposure device) 3 using a semiconductor laser is used. The laser beam scanner 3 outputs laser light L modulated correspondingly to an image signal sent from a host apparatus such as an image reader (not shown) to the image forming apparatus 100. The laser beam scanner 3 effects scanning exposure of the uniformly charged surface of the rotating photosensitive drum 1 to the laser light L. An exposed portion exposed to the laser light L on the surface of the photosensitive drum 1 is lowered in potential, so that an electrostatic image corresponding to image information is formed on the surface of the rotating photosensitive drum 1. In this embodiment, with respect to the electrostatic image, an image portion on which the toner is to be deposited is exposed to the laser light L (image exposure). In this embodiment, a light portion potential V1 is −150 V. An exposed position on the peripheral surface of the photosensitive drum 1 by the image exposure light L is an exposed portion b.

In this embodiment, the developing device 4 as the developing means is a two-component contact developing device (two-component magnetic brush developing device) using a two component developer 46, as a developer, comprising a mixture of non-magnetic resin material toner particles (toner) and magnetic carrier particles (carrier). The developing device 4 includes a developing container (developing device body) 40, in which the two component developer 46 is accommodated. The developing container 40 is provided with a developing sleeve 41 as a developer carrying member containing a fixedly disposed magnet roller as a magnetic field generating means and a developer regulating blade 42 as a developer regulating member. The developing sleeve 41 is disposed rotatably in the developing container 40 so that a part of an outer peripheral surface thereof is exposed to the outside of the developing container 40. On a bottom side of the developing container 40, first and second stirring screws 43 and 44 as a developer stirring member are provided.

The developer regulating blade 42 is disposed to oppose the developing sleeve 41 with a predetermined gap. The developer regulating blade 42 forms a thin layer of the two component developer 46 on the developing sleeve 41 by the rotation of the developing sleeve 41 in a direction of an indicated arrow R2 (counterclockwise direction). In this embodiment, the developing sleeve 41 is disposed closely and oppositely to the photosensitive drum 1 with a closest distance between the developing sleeve 41 and the photosensitive drum 1 (S-Dgap) kept at 350 μm. The opposing portion between the developing sleeve 41 and the photosensitive drum 1 is a developing portion c.

In this embodiment, the developing sleeve 41 is rotationally driven in the (counterclockwise) direction of the arrow R2 so that the movement directions of the surface of the photosensitive drum 1 and the surface of the developing sleeve 41 are opposite from each other at the developing portion c. The thin layer of the two component developer 46 on the developing sleeve 41 contacts the surface of the photosensitive drum 1 at the developing portion to properly rub the surface of the photosensitive drum 1. To the developing sleeve 41, a predetermined developing bias voltage is applied from a developing bias voltage supply (not shown) as a developing voltage applying means. In this embodiment, the developing bias voltage is an oscillating voltage in the form of a superposed (biased) voltage between a DC voltage (Vdc) of −350 V and an AC voltage (Vac) having a peak-to-peak voltage Vpp of 1800 V and a frequency of 12300 Hz.

The toner of the two component developer 46 which is coated on the developing sleeve 41 in the thin layer and conveyed to the developing portion c is selectively deposited on the surface of the photosensitive drum 1 correspondingly to the electrostatic image on the photosensitive drum 1. As a result, the electrostatic image on the photosensitive drum 1 id developed as a toner image. In this embodiment, the electrostatic image is developed by the reverse developing method. That is, the toner electrically charged to the same polarity as the charge polarity of the photosensitive drum 1 is deposited on the exposed portion (light portion) on the photosensitive drum 1 where electric charges are attenuated after the photosensitive drum surface is electrically charged. The thin layer of the two component developer 46 on the developing sleeve 41 passing through the developing portion c is returned to a developer retaining portion in the developing container 40 by further rotation of the developing sleeve 41.

The first and second stirring screws 43 and 44 provided in the developing device 4 rotate in synchronism with the rotation of the developing sleeve 41, thus having a function of imparting predetermined charges to the toner by stirring and mixing the toner supplied to the developing container 40 with the carrier in the developing container 40. Further, these two stirring screws 43 and 44 are disposed substantially in parallel to each other, thus having a function of conveying the two component developer 46 so that movement directions thereof in the longitudinal directions (rotational axis directions) of the two stirring screws 43 and 44 are opposite from each other to circulate the two component developer 46 in the developing container 40. That is, the stirring screws 43 and 44 not only conveys and supplies the two component developer 46 to the developing sleeve 41 but also conveys the two component developer 46 decreased in toner concentration (ratio of toner in the two component developer) in the developing step to a toner supplying portion where the toner is supplied into the developing container 40.

On a wall surface of the developing container 40 on a upstream side with respect to the conveyance direction of the two component developer 46 by the second stirring screw 44, a sensor 45 for detecting the toner concentration in the two component developer 46 through detection of a change in a magnetic permeability of the two component developer 46. On a somewhat downstream side of the sensor 45 with respect to the circulation direction of the two component developer 46 in the developing container 40, a toner supplying opening 47 is provided. After the developing operation is performed, the two component developer 46 is conveyed to a detecting portion for detecting the toner concentration by the sensor 45. Depending on a detection result of the sensor 45, the toner is appropriately supplied into the developing container 40 through the toner supplying opening 47 of the developing device 4. A toner supplying unit 5 supplies a desired amount of the toner to the developing device 4 by rotating a screw 51 provided to the toner supplying unit 5 so as to keep the toner concentration of the two component developer 46 at a constant level. The toner supplied to the developing device 4 is conveyed by the stirring screw 44 and mixed with the carrier so that the appropriate electric charges are imparted to the toner. Thereafter, the toner is conveyed to a portion in the neighborhood of the developing sleeve 41 and coated in a thin layer on the developing sleeve 41 to be subjected to the development.

In this embodiment, as the toner, negatively chargeable toner having an average particle size of 5.5 μm is used. As the carrier, a magnetic carrier having saturation magnetization of 205 emu/cm$^3$ and an average particle size of 35 μm is used. These toner and carrier are mixed in a ratio of 6:94 by weight to prepare the two component developer.

In this embodiment, the intermediary transfer unit 9 includes the endless belt member, i.e., the intermediary transfer belt 91 as a movable intermediary transfer member (second image bearing member). The intermediary transfer belt 91 is extended around a driving roller 94, a tension roller 95 and the secondary transfer opposite roller 96 as a plurality of supporting members with a predetermined tension. Then, the intermediary transfer belt 91 is rotationally driven by rotation of the driving roller 94 in a direction of an indicated arrow R3 (clockwise direction) to circulatingly move (rotate) in a direction of an indicated arrow R4 (clockwise direction). An opposite portion between the intermediary transfer belt 91 and the photosensitive drum 1 on the peripheral surface of the photosensitive drum 1 is a transfer position d, in which the photosensitive drum 1 and the intermediary transfer belt 91 contact each other to form the primary transfer portion (primary transfer nip) N1.

The primary transfer roller 92 as the primary transfer means presses the intermediary transfer belt 91 against the photosensitive drum 1 at the transfer position d. To each primary transfer roller 92, a primary transfer bias voltage source E2 as a primary transfer voltage applying means is connected in order to apply the primary transfer bias voltage independently at each image forming station s.

In this embodiment, in view of a transfer efficiency of the toner transferred to the exposed portion (light portion potential VL: −150 V), to all the primary transfer rollers 92 of the image forming stations S, a DC voltage of +350 V as the primary transfer bias voltage is applied.

As the intermediary transfer belt 91, a belt of a resinous material, a rubber belt containing a metal core, or a belt of a resin material or a rubber may suitably be used. In addition, as the intermediary transfer belt 91, from the viewpoint of improvement in image quality such as improvement of a degree of toner scattering or voids, a belt having an elastic layer may also be used. In this embodiment, as the intermediary transfer belt 91, a resin material belt which contains carbon black dispersed in polyimide (PI) as an electroconductive agent to control a volume resistivity on the order of $10^8$ Ωcm. Further, the intermediary transfer belt 91 has a thickness of 80 μm, a longitudinal length of 320 mm (with respect to a direction perpendicular to the surface movement direction), and a full circumferential length of 900 mm.

In this embodiment, as the primary transfer roller 92, a roller including a core metal and an elastic layer of electroconductive sponge provided on the core metal. The primary transfer roller 92 has an electric resistance of $10^6$Ω or less, an outer diameter of 16 mm, and a longitudinal length of 315 mm (with respect to the rotational axis direction).

The first and second auxiliary charging brushes 6 and 7 disposed in contact with the photosensitive drum 1 will be specifically described later. Here, with respect to the movement direction of the photosensitive drum surface, the first auxiliary charging brush 6 on an upstream side (close to the primary transfer roller 92 is referred to as the "upstream brush", and the second auxiliary charging brush 7 on a downstream side is referred to as the "downstream brush". On the peripheral surface of the photosensitive drum 1, a contact portion with the upstream brush 6 is an upstream toner charging portion e and a contact portion with the downstream brush 7 is a downstream toner charging portion f.

The operation of the image forming apparatus 100 of this embodiment is described above by taking the case of forming the full-color image as an example but the image forming apparatus 100 of this embodiment is also capable of forming a single color image or a multiple color image by using only any one or several ones of the plurality of the image forming station S.

[Auxiliary Charging Brush]

As described above, in the cleaner-less system using the auxiliary charging brushes, there can arise the problem of the decrease in amount of current passing through the auxiliary charging brush (i.e., the brush current amount) due to the "clogging with toner" phenomenon of the auxiliary charging brush.

As a result of study by the present inventor, as the brush current amount of the upstream brush 6 and the brush current amount of the downstream brush 7, an estimated necessary current amount may be 10 μA or more.

For example, in the case where the brush current amount of the upstream brush 6 is decreased to less than 10 μA, the latent image potential remains on the photosensitive drum 1, so that the ghost phenomenon in which the preceding image is superposed on the current image can occur. Further, in the case where the brush current amount of the upstream brush 6 is decreased to less than 10 μA, electrical discharge is not generated by the downstream brush and the transfer residual toner is collected by the downstream brush, so that the brush current amount of the downstream brush 7 is also decreased. On the other hand, in the case where the brush current amount of the downstream brush 7 is decreased, control of the charge polarity of the transfer residual toner cannot be performed properly, so that toner having a reversed charge polarity can remain on the photosensitive drum 1 in a large amount. This toner is not collected by the developing device 4 to deposit on a subsequent toner image in some cases, i.e., image failure such as fog due to such a phenomenon can occur. Further, in the case where the brush current amount of the downstream brush is decreased, the charging of the photosensitive drum 1 by the charging roller 2 is not uniform, so that image failure such as sandpaper-like fog can occur.

A principal object of the present invention is to suppress the clogging with toner of the brush constituting the auxiliary charging means. A specific object of the present invention is to facilitate charging of the transfer residual toner to the regular charge polarity by suppressing the clogging of the brush with the toner. Another specific object of the present invention is to improve a toner collecting rate by suppressing the clogging of the brush with the toner, thus improving a toner utilization efficiency. A further specific object of the present invention is to suppress occurrences of disadvantages such as the ghost phenomenon, the fog caused by the transfer residual toner deposited on the subsequent toner image, and the sandpaper-like fog.

In this embodiment, the image forming apparatus 100 includes the photosensitive drum 1 as the movable image bearing member, the charging roller 2 as the charging means for electrically charging the surface of the photosensitive drum 1, the laser beam scanner 3 as the electrostatic image forming means for forming the electrostatic image on the surface of the photosensitive drum 1 electrically charged by the charging roller 2, the developing device 4 as the developing means for developing the electrostatic image formed on the photosensitive drum 1 with the toner, and the primary transfer roller 92 as the transfer means for transferring the toner image formed on the photosensitive drum 1 onto the intermediary transfer belt 91 as the toner image receiving member.

Further, the image forming apparatus 100 includes the upstream brush 6 as the first brush and the downstream brush 7 as the second brush. Specifically, the image forming apparatus 100 includes the upstream brush 6 as the first auxiliary charging means which is disposed downstream of the primary transfer roller 92 in contact with the photosensitive drum 1 with respect to the movement direction of the photosensitive drum 1 and is supplied with the voltage of the polarity opposite to the regular charge polarity of the toner. That is, the upstream toner charging portion e as the contact portion between the upstream brush 6 and the photosensitive drum 1 is located downstream of the primary transfer position d. The upstream brush 7 has the function of uniformizing the potential of the photosensitive drum 1 and the function of electrically discharging (and/or charging) the photosensitive drum 1.

Further, the image forming apparatus 100 includes the downstream brush 7 as the second auxiliary charging means which is disposed downstream of the upstream brush 6 and upstream of the charging roller 2 in contact with the photosensitive drum 1 with respect to the movement direction of the photosensitive drum 1 and is supplied with the voltage of the polarity identical to the regular charge polarity of the toner. That is, the downstream toner charging portion f as the contact portion between the downstream brush 7 and the photosensitive drum 1 is located downstream of the upstream toner charging portion e and upstream of the charging portion a as the contact portion between the charging roller 2 and the photosensitive drum 1. The downstream brush 6 has the function of electrically charging the toner on the photosensitive drum 1 to the regular charge polarity and the function of electrically charging the photosensitive drum 1.

In the image forming apparatus 100, the toner which is not transferred onto the intermediary transfer belt 91 by the primary transfer roller 92 to remain on the surface of the photosensitive drum 1 and has passed through the respective contact portions between the photosensitive drum 1 and the respective upstream and downstream brushes 6 and 7 is collected by the developing device 4.

Particularly, in this embodiment, each of the upstream brush 6 and the downstream brush 7 is collected by a brush formed of electroconductive fibers and the brush constituting the upstream brush 6 has a fiber density smaller than that of the brush constituting the downstream brush 7.

When the brush has a density of the fibers (furs) which is too sparse, the current amount is excessively small. On the other hand, when the brush has a density of the fibers (furs) which is too dense, the brush is clogged with the toner. Herein, the fiber density of the brush is the number of fibers to be planted per unit area when the brush is prepared by planting a plurality of fibers (furs). The plurality of preparing the brush by being planted may be filaments, a strand consisting of a plurality of filaments twisted together, or a fiber bundle consisting of a plurality of strands twisted together.

The upstream brush 6 may preferably have a fiber density of 80 kF/inch$^2$ or more and 250 kF/inch$^2$ or less (i.e., 80×10$^3$ fibers/inch$^2$ or more and 250×10$^3$ fibers/inch$^2$ or less). The downstream brush 7 may preferably have a fiber density of 300 kF/inch$^2$ or more and 600 kF/inch$^2$ or less (i.e., 300×10$^3$ fibers/inch$^2$ or more and 600×10$^3$ fibers/inch$^2$ or less). Further, each of the brushes constituting the upstream brush 6 and the downstream brush 7 may preferably have fineness of 0.5 denier (d) or more and 4 deniers (d) or less. Each of the brushes constituting the upstream brush 6 and the downstream brush 7 may preferably have an original yarn resistance of 10$^5$Ω or more and 10$^8$Ω or less.

A large amount of the transfer residual toner with the reversed charge polarity enters the upstream brush 6, so that the upstream brush 6 is preferably configured so that the fibers do not contact each other. Specifically, the fiber density of the brush is relatively sparse (80 kF/inch$^2$-250 kF/inch$^2$), the fineness of the fibers is small (0.5 d-4 d), and the original yarn resistance is low (10$^5$Ω-10$^8$Ω). As a result, the clogging of the upstream brush 6 with the toner can be suppressed to a minimum and the potential of the photosensitive drum 1 can be uniformized by the electric discharge current.

The downstream brush 7 is configured to uniformly rub the photosensitive drum 1 in order to return the charge polarity of the transfer residual toner to the regular charge polarity. Specifically, the fineness of the fibers is small (0.5 d-4 d) and the original yarn resistance is low (10$^5$Ω-10$^8$Ω). Further, the fiber density of the brush is relatively dense (300 kF/inch$^2$-600 kF/inch$^2$). As a result, the downstream brush 7 is capable of electrically charging the toner to the regular charge polarity by sufficient electric discharge and preventing the toner from being collected by the downstream brush 7. Thus, it is possible to suppress the clogging of the downstream brush 7 with the toner to a minimum.

The fibers used for the upstream brush 6 and the downstream brush 7 may preferably have standard moisture regain of 6.5% or more. In the case of a fiber having the standard moisture regain exceeding 6.5%, i.e., a large hygroscopic degree, such as rayon, the fiber is sagged to lose its firmness in a high-humidity environment. As a result, the toner is liable to remain between the fibers and the photosensitive drum 1. Specifically, it is preferable that a brush prepared by incorporating carbon black or metal powder in synthetic fiber such as nylon or polyester to control an electric resistance so as to have standard moisture regain of 4% or less is used.

For the reason of manufacturing, it is difficult to decrease the fineness of the fibers constituting the brush to less than 0.5 d. Further, in the case where the fineness of the fibers constituting the brush is increased to more than 4 d, the fibers are decreased in surface area per unit volume, so that the amount of current passing through the photosensitive drum 1 is liable to be decreased. Further, it is difficult to form a brush having a fiber density of less than 80 kF/inch$^2$ or a fiber density of more than 600 kF/inch$^2$. Further, when the original yarn resistance of the fibers constituting the brush is less than 10$^5$Ω, the current amount is excessively increased, so that risk of burn-out of the fibers is undesirably increased. On the other hand, when the original yarn resistance exceeds 10$^8$Ω, a high voltage of 1 kV or more for carrying a sufficient current amount (10 μA or more) is undesirably required.

Further, in this embodiment, the upstream brush 6 includes an elongated electrode plate 62 extending along the longitudinal direction (rotational axis direction) of the photosensitive drum 1 and a brush portion 61 provided on the electrode plate 62. The electrode plate 62 may also function as a supporting member on which fibers for forming the brush portion 61 are planted. The downstream brush 7 has the same constitution as the upstream brush 6. That is, the downstream brush 7 includes an elongated electrode plate 72 extending along the longitudinal direction (rotational axis direction) of the photosensitive drum 1 and a brush portion 71 provided on the electrode plate 71. The electrode plate 72 may also function as a supporting member on which fibers for forming the brush portion 71 are planted. As described above, in this embodiment, each of the upstream brush 6 and the downstream brush 7 is an enlarged brush member which is fixedly disposed.

The upstream brush 6 and the downstream brush 7 are disposed in contact with the surface of the photosensitive drum 1 at the brush portions 61 and 71, respectively, and substantially in parallel to the longitudinal direction of the photosensitive drum 1, i.e., a direction perpendicular to the surface movement direction of the photosensitive drum 1. In this embodiment, the upstream brush 6 and the downstream brush 7 are fixedly supported by the process cartridge 8 so as not to be movable relative to the apparatus main assembly in an operating state.

More specifically, in this embodiment, the fibers constituting the upstream brush 6 have fineness of 2 d, a fiber density of 80 kF/inch$^2$, and an original yarn resistance of 10$^7$Ω, and the fibers constituting the downstream brush 7 have fineness of 2 d, a fiber density of 430 kF/inch$^2$, and an original yarn resistance of 10$^7$Ω. As the fibers constituting the upstream brush 6 and the downstream brush 7, a synthetic fiber of nylon as a base material in which carbon black is contained as the electroconductive agent to have standard moisture regain of 4.0%.

In this embodiment, particularly, the brush portions 61 and 71 of the upstream and downstream brushes 6 and 7 are constituted by planting electroconductive fibers on a base cloth through W weave. More specifically, each of the brush portions 61 and 71 is formed by planting the fibers having the above-described fiber density on a base cloth having a longitudinal length of 313 mm and a width of 5 mm so that the fibers have a pile length of 5 mm. Each of the brush portions 61 and 71 is attached to the electroconductive support functioning as each of the electrode plates 61 and 71. To these electrode plates 61 and 71, first and second auxiliary charging bias voltage sources E3 and E4 as auxiliary charging voltage applying means are connected, respectively. Further, in this embodiment, each of the upstream brush 6 and the downstream brush 7 is brought into contact with the photosensitive drum 1 so that a penetration amount of each of the brush portions 61 and 71 with respect to the surface of the photosensitive drum 1 is 1 mm. The penetration amount is a distance of movement of an end of the brush in a direction normal to the surface of the photosensitive drum 1 in a pressing operation.

Generally, the transfer residual toner which has not been transferred onto the transfer material P at the transfer position d to remain on the photosensitive drum 1 contains reversely charged toner having a polarity opposite to the regular charge polarity and toner having an improper charge amount in mixture.

According to this embodiment, the photosensitive drum 1 can be effectively discharged electrically by the upstream brush 6 and then the transfer residual toner can be effectively charged electrically to the regular charge polarity by the downstream brush 7. As a result, deposition of the transfer residual toner on the charging roller 2 can be effectively prevented and it is also possible to effectively remove and collect the transfer residual toner by the developing device 4. Further, the occurrence of the ghost image of the transfer residual toner image pattern can be strictly prevented.

Next, in order to evaluate a state of a decrease in brush current amount due to the clogging of the upstream brush 6 and the downstream brush 7 with the toner and a degree (level) of an occurrence of a sandpaper like fog, the following experiment was conducted. That is, in an environment of 23° C./5%, continuous image formation of an image on 6000 sheets of A4-size paper at a print ratio of 20%. The sheets are fed by a landscape feeding operation and a state of the occurrence of the sandpaper-like fog on the image was observed every 10,000 sheets. The image for evaluation was a halftone image (image density: about 0.4) faithfully reflecting a charging state of the photosensitive drum 1. The sandpaper-like fog means such an image that a white spot (a portion of a white image at which the toner is not deposited) is formed at the halftone portion. The sandpaper-like fog can be evaluated by outputting a halftone image having a length longer than a circumferential length of the charging roller 2. In the case where the white spot occurred, it was judged that the sandpaper-like fog occurred. On the other hand, in the case where no white spot occurred, it was judged that the sandpaper-like fog did not occur.

Table 1 shows a result of the evaluation of the above described experiment in this embodiment ("EMB. 1"). In Table 1, as a comparative embodiment ("COMP. EMB. 1"), an evaluation result of the case where each of the upstream brush 6 and the downstream brush 7 has fiber fineness of 2 d and a fiber density of 80 kF/inch$^2$ is also shown.

TABLE 1

| Sheet(s) | COMP. EMB. 1 | EMB. 1 |
|---|---|---|
| 0 | A*1 | A |
| 10,000 | A | A |
| 20,000 | B*2 | A |
| 30,000 | B | A |
| 40,000 | C*3 | A |
| 50,000 | C | A |
| 60,000 | D*4 | A |

*1No image defect (failure) occurred.
*2The sandpaper-like fog partially occurred due to charging failure.
*3The sandpaper-like fog occurred in the entire area.
*4The sandpaper-like fog occurred in the entire area and a fog due to the transfer residual toner deposited on a subsequent toner image occurred.

From the results shown in Table 1, it is understood that at an initial state, the photosensitive drum 1 can be sufficiently charged uniformly in both of the constitutions of this embodiment and the comparative embodiment.

However, in the case where the evaluation image with the print ratio of 20% is continuously formed on 20,000 sheets or more, in the comparative embodiment, it is found that an insufficiently charged portion occurs in a part of the area of the photosensitive drum 1. Further, in the case of the image formation on 40,000 sheets or more, the insufficiently charged portion occurs in the entire area of the photosensitive drum 1. Further, at the time of the image formation on 60,000 sheets, the fog due to the transfer residual toner deposited on the subsequent image also occurs on the photosensitive drum 1. This may be attributable to such a phenomenon that the clogging of the downstream brush 7 with the toner expands to the entire longitudinal area and pre-electric charging cannot be performed sufficiently. On the other hand, in this embodiment, even in the case of performing the continuous image formation on 20,000 sheets or more, it is possible to electrically charge the photosensitive drum 1 uniformly.

Next, in order to evaluate a state of a decrease in brush current amount due to the clogging of the upstream brush 6 and the downstream brush 7 with the toner and a degree (level) of an occurrence of ghost, the following experiment was conducted. That is, in an environment of 23° C./5%, continuous image formation of an image on 6000 sheets of A4-size paper at a print ratio of 20%. The sheets are fed by a landscape feeding operation and a state of the occurrence of the ghost on the image was observed every 10,000 sheets. The image for evaluation was an image provided with a solid print image portion (with a maximum density) prepared for ghost evaluation at a leading end of the image and also provided with a halftone image portion (image density: about 0.4) provided at a position corresponding to one circumferential length of the photosensitive drum 1. In the case where an image corresponding to the solid image portion occurred at the halftone image portion, it was judged that the ghost occurred. On the other hand, in the case where no image defect occurred, it was judged that the ghost did not occur.

Table 2 shows a result of the evaluation of the above described experiment in this embodiment ("EMB. 1"). In Table 1, as a comparative embodiment ("COMP. EMB. 2"), an evaluation result of the case where each of the upstream brush 6 and the downstream brush 7 has fiber fineness of 2 d and a fiber density of 430 kF/inch$^2$ is also shown.

TABLE 2

| Sheet(s) | COMP. EMB. 2 | EMB. 1 |
|---|---|---|
| 0 | A*1 | A |
| 10,000 | A | A |
| 20,000 | B*2 | A |
| 30,000 | B | A |
| 40,000 | B | A |
| 50,000 | B | A |
| 60,000 | B | A |

*1No ghost occurred.
*2Ghost occurred.

From the results shown in Table 2, it is understood that at an initial state, the ghost do not occur in both of the constitutions of this embodiment and the comparative embodiment.

However, in the case where the evaluation image with the print ratio of 20% is continuously formed on 20,000 sheets or more, in the comparative embodiment, it is found that the ghost occurs. This may be attributable to such a phenomenon that the clogging of the upstream brush 6 with the toner occurs and removal of a latent image formed during preceding image formation cannot be performed sufficiently. On the other hand, in this embodiment, as shown in Table 2, even in the case of performing the continuous image formation on 20,000 sheets or more, it is possible to remove the latent image formed during the preceding image formation with no problem.

From the above results, in this embodiment, it is understood that the amount of the decrease in brush current amount of the upstream brush 6 and the downstream brush 7 can be suppressed at a level of no occurrence of the image defect even at the time of formation of the above described evaluation images on 60,000 sheets.

As described above, according to this embodiment, it is possible to suppress the clogging with the toner of the brushes as the auxiliary charging means. Further, it is also possible to facilitate electric charging of the transfer residual toner to the regular charge polarity by the suppression of the clogging with the toner. Further, by the suppression of the clogging with the toner, it is possible to improve a toner collecting rate and thereby to improve a toner utilization efficiency. Further, by the suppression of the clogging with the toner, it is also possible to suppress the image defects (failure) such as the ghost phenomenon, the fog due to the transfer residual toner deposited on the subsequent toner image, and the sandpaper-like fog.

Therefore, according to this embodiment, it is possible to establish a cleaner-less system which suppresses the decrease in brush current amount due to the clogging of the brushes with the toner and suppresses the occurrence of the image defects. For that reason, this embodiment is very advantageous for realization of an image forming apparatus which is capable of stably forming an image for a long term and has a long lifetime and low running cost.

The present invention is not limited to the above-described embodiment but may also be applicable to other embodiments.

Figure 3:
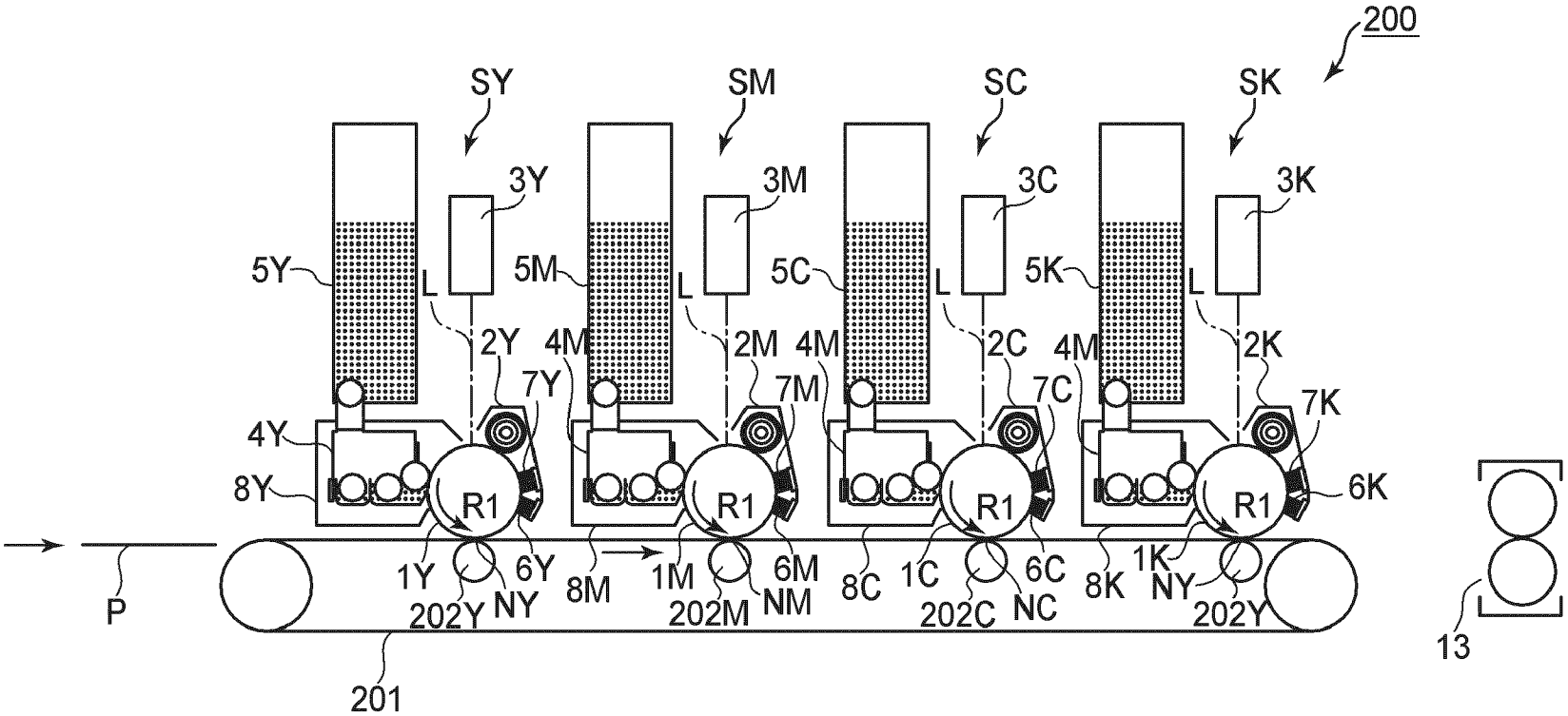
FIG. 3 is a schematic sectional view for illustrating another structure of the image forming apparatus of the present invention.

For example, the image forming apparatus of the above-described embodiment is described as the color image forming apparatus using the intermediary transfer method and the tandem arrangement but the present invention is not limited thereto. The image forming apparatus according to the present invention may also be a color image forming apparatus employing a direct transfer method and the tandem arrangement shown in FIG. 3. In an image forming apparatus 200 shown in FIG. 3, constituents or means identical or corresponding to those of the image forming apparatus 100 shown in FIG. 1 are represented by the same reference numerals. The image forming apparatus 200 shown in FIG. 3 includes, instead of the intermediary transfer member 91 functioning as the toner image receiving member in the above-described embodiment, e.g., a conveyance belt 201 which is an endless belt-like member as a transfer material carrying member, functioning as the toner image receiving member, for carrying and conveying the transfer material P. Then, in the same manner as in the above-described embodiment, different color toner images formed on the photosensitive drums 1 of the respective image forming stations S are successively transferred onto the transfer material P, as the toner image receiving member carried and conveyed on the conveyance belt 201, by the action of a transfer roller 202 as the transfer means in a superposition manner. Thereafter, the multiple toner images transferred onto the transfer material P are fixed on the transfer material P by a fixing device 13 to provide an output color image. The present invention is also equivalently applicable to a monochromatic image forming apparatus including a single image forming station for transferring a toner image formed on a photosensitive member onto a toner image receiving material. Also in these image forming apparatuses of other embodiments, it is also possible to achieve effects similar to the above-described embodiments by employing the constitutions of the first and second auxiliary charging means provided to the image forming station(s).

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 210553/2007 filed Aug. 10, 2007, which is hereby incorporated by reference.

What is claimed is:

1. An image forming apparatus comprising:

a photosensitive member;

a charging member configured to electrically charge said photosensitive member at a photosensitive member charging position to form an electrostatic image on said photosensitive member;

a developing device configured and positioned to develop the electrostatic image on said photosensitive member with toner to form a toner image;

a transferring device configured to transfer the toner image on said photosensitive member to an image receiving member at a transfer position;

a first brush, disposed at a position which is downstream of the transfer position and is upstream of the photosensitive member charging position with respect to a rotational direction of said photosensitive member, configured to electrically charge a residual toner on said photosensitive member at a toner charging position to collect the residual toner to said developing device, said first brush being supplied with a charging bias having a polarity opposite to a regular charge polarity of the toner; and a second brush, disposed at a position which is downstream of the toner charging position and is upstream of the photosensitive member charging position with respect to the rotational direction, configured to electrically charge the residual toner on said photosensitive member, said second brush being supplied with a charging bias having a polarity which is same as the regular charge polarity, wherein said first brush has a fiber density of 80 kF/inch$^2$ or more and 250 kF/inch$^2$ or less and said second brush has a fiber density of 300 kF/inch$^2$ or more and 600 kF/inch$^2$ or less, and wherein said first brush and said second brush have a fineness of 0.5 denier or more and 4 deniers or less.

2. An apparatus according to claim 1, wherein said first brush and said second brush have an original yarn resistance of $10^5\Omega$ or more and $10^8\Omega$ or less.

3. An apparatus according to claim 1, wherein the image receiving member is an intermediary transfer member which receives the toner image from said photosensitive member and which transfers the toner image to a recording sheet.

4. An apparatus according to claim 1, wherein said transferring device transfers the toner image from said photosensitive member to a recording sheet as the image receiving member.

5. An image forming apparatus comprising:

a photosensitive member;

a charging member configured to electrically charge said photosensitive member at a photosensitive member charging position to form an electrostatic image on said photosensitive member;

a developing device configured and positioned to develop the electrostatic image on said photosensitive member with toner to form a toner image;

a transferring device configured to transfer the toner image on said photosensitive member to an image receiving member at a transfer position;

a first brush, disposed at a position which is downstream of the transfer position and is upstream of the photosensitive member charging position with respect to a rotational direction of said photosensitive member, configured to electrically charge a residual toner on said photosensitive member at a toner charging position to collect the residual toner to said developing device, said first brush being supplied with a charging bias having a polarity opposite to a regular charge polarity of the toner; and a second brush, disposed at a position which is downstream of the toner charging position and is upstream of the photosensitive member charging position with respect to the rotational direction, configured to electrically charge the residual toner on said photosensitive member, said second brush being supplied with a charging bias having a polarity which is same as the regular charge polarity, wherein said first brush has a fiber density of 80 kF/inch$^2$ or more and 250 kF/inch$^2$ or less and said second brush has a fiber density of 300 kF/inch$^2$ or more and 600 kF/inch$^2$ or less.

6. An apparatus according to claim 5, wherein said first brush and said second brush have an original yarn resistance of $10^5\Omega$ or more and $10^8\Omega$ or less.

7. An apparatus according to claim 5, wherein the image receiving member is an intermediary transfer member which receives the toner image from said photosensitive member and which transfers the toner image to a recording sheet.

8. An apparatus according to claim 5, wherein said transferring device transfers the toner image from said photosensitive member to a recording sheet as the image receiving member.

* * * * *